US005418420A

United States Patent [19]

Roberts

[11] Patent Number: 5,418,420

[45] Date of Patent: May 23, 1995

[54] ARC LAMP WITH A TRIPLET REFLECTOR INCLUDING A CONCAVE PARABOLIC SURFACE, A CONCAVE ELLIPTICAL SURFACE AND A CONVEX PARABOLIC SURFACE

[75] Inventor: Roy D. Roberts, Newark, Calif.

[73] Assignee: ILC Technology, Inc., Sunnyvale, Calif.

[21] Appl. No.: 80,759

[22] Filed: Jun. 22, 1993

[51] Int. Cl.[6] ..... H01J 5/16

[52] U.S. Cl. ..... 313/114; 313/113; 362/297; 362/302; 362/304; 362/346; 362/347

[58] Field of Search ..... 313/113, 114, 634, 570; 362/263, 296, 297, 298, 302, 304, 346, 347

[56] References Cited

U.S. PATENT DOCUMENTS

| | | | |
|---|---|---|---|
| 2,799,791 | 7/1957 | Honing et al. | 313/114 |
| 3,610,912 | 10/1971 | Schwartz | 240/1.2 |
| 3,808,496 | 4/1974 | McRae et al. | 313/113 |
| 3,835,342 | 9/1974 | Freeman | 313/114 |
| 4,536,834 | 8/1985 | Sands et al. | 313/113 |
| 4,599,540 | 7/1986 | Roberts | 313/570 |
| 4,633,126 | 12/1986 | Giller et al. | 313/113 |
| 4,633,128 | 12/1986 | Roberts et al. | 313/113 |
| 4,658,179 | 4/1987 | Roberts | 313/113 |
| 4,739,152 | 4/1988 | Downs | 313/113 |
| 4,788,469 | 11/1988 | Holten | 313/113 |
| 5,099,168 | 3/1992 | Holten | 313/114 |

FOREIGN PATENT DOCUMENTS

| | | | |
|---|---|---|---|
| 162532 | 5/1953 | Australia | 313/114 |
| 410524 | 1/1991 | European Pat. Off. | 313/113 |
| 657243 | 9/1951 | Netherlands | 313/113 |
| 2097997 | 11/1982 | United Kingdom | 313/113 |
| 2123603 | 2/1984 | United Kingdom | 313/113 |

*Primary Examiner*—Sandra L. O'Shea
*Assistant Examiner*—Matthew J. Esserman
*Attorney, Agent, or Firm*—Thomas E. Schatzel

[57] ABSTRACT

An arc lamp embodiment of the present invention comprises a triplet set of annular reflectors that gather light from an arc created between an anode and a cathode into essentially parallel beams that exit along the longitudinal axis of the generally cylindrical lamp through a sapphire window. A first of the three reflectors has a concave parabolic shape that reflects light out along the lamp axis in one bounce. A second of the three reflectors has a concave elliptical shape with a rear projecting focus and is back to back with the first reflector such that the open bowls of the reflectors face in opposite directions along the axis of the lamp. A third of the three reflectors has a convex parabolic shape that receives light bounced from the second reflector and gives it a second bounce out through an opening in the first reflector and then through the window, parallel to the lamp axis. The third reflector is concentric with the first and second reflectors and its body bows into the bowl of the second reflector.

14 Claims, 4 Drawing Sheets

100
80
60
40
20
0
Relative Intensity (Lumens)
80
50%
82
-8°
-6°
-4°
-2°
0°
+2°
+4°
+6°
+8°
Beam Angle (Degrees)

ARC LAMP WITH A TRIPLET REFLECTOR INCLUDING A CONCAVE PARABOLIC SURFACE, A CONCAVE ELLIPTICAL SURFACE AND A CONVEX PARABOLIC SURFACE

BACKGROUND OF THE INVENTION

1. Field of the Invention

The invention relates generally to arc lamps and specifically to lamps with heterogeneous curvature reflector surfaces for narrow light beam control.

2. Description of the Prior Art

Short arc lamps provide intense point sources of light that allow light collection in reflectors for applications in medical endoscopes, instrumentation and projection. Short arc lamps are used in industrial endoscopes for the inspection of jet engine interiors.

A typical short arc lamp comprises an anode and a cathode positioned along the longitudinal axis of a cylindrical, sealed concave chamber that contains a gas pressurized to several atmospheres. U.S. Pat. No. 4,633,128, issued Dec. 30, 1986, to Roy D. Roberts, the present inventor, and Robert L. Miner, describes such a short arc lamp in which a copper sleeve member is attached to the reflecting wall to conduct heat from the reflecting wall through to the exterior wall and eventually to circulating ambient air.

The lamp illustrated in FIG. 2 of Roberts, et al., can be operated at one kilowatt. At higher power levels, the heat generated by an electric arc between cathode 48 and anode 50 encounters too much thermal resistance to the amient and the lamp can overheat and fail. Specifically, applying too much power to the lamp creates thermal gradients in the ceramic material that will cause cracks in the body and possibly an explosion of a weakened lamp.

FIG. 1 illustrates a prior art short arc lamp 10. The lamp 10 comprises a cathode 12, a cathode suspension strut 13, an anode 14, a reflecting concave wall 16 in a ceramic alumina body 18, a window 20, metallic base 22, a first metal band 24, a second metal band 26 and a copper heat-transfer pad 28. In operation, an electric arc 30 bridges the gap between cathode 12 and anode 14. Base 22 is typically comprised of iron and functions to electrically connect anode 14 to first metal band 24. Heat generated by electric arc 30 is conducted away by passing through body 18, especially wall 16 near anode 14 to copper heat-transfer pad 28 and again through body 18 to first metal band 24. An air fin heat sink, not shown, slips over and tightly around first metal band 24 to provide heat sinking to circulating forced air. A second heat path is through anode 14 and rear of base 22 and to first metal band 24.

However, conventional lamps cannot concentrate their outputs into narrow beams very well. A more efficient beam control is needed to improve narrow beam emission and thereby operate more efficiently and more effectively in particular applications.

SUMMARY OF THE PRESENT INVENTION

It is therefore an object of the present invention to provide an arc lamp that concentrates its light output in a narrow beam.

Briefly, an embodiment of the present invention is an arc lamp comprising a triplet set of annular reflectors that gather the light from an arc created between an anode and a cathode into essentially parallel beams that exit along the longitudinal axis of the generally cylindrical lamp through a glass lens. A first of the three reflectors has a concave parabolic shape that reflects light out along the lamp axis in one bounce. A second of the three reflectors has a concave elliptical shape and is back to back with the first reflector such that the open bowls of the reflectors face in opposite directions along the axis of the lamp. A third of the three reflectors has a convex parabolic shape that receives light bounced from the second reflector and gives it a second bounce out through the lens and parallel to the lamp axis. The third reflector is concentric with the first and second reflectors and its body bows into the bowl of the second reflector.

An advantage of the present invention is that a lamp is provided with a "flat-top" beam that has better uniformity over conventional lamps.

Another advantage of the present invention is that a lamp is provided with a "flat-top" beam that has improved control over conventional lamps.

A further advantage of the present invention is that a lamp is provided with a "flat-top" beam that has approximately a 13% increase in output level over conventional, otherwise equivalent lamps.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENTS

Figure 1:
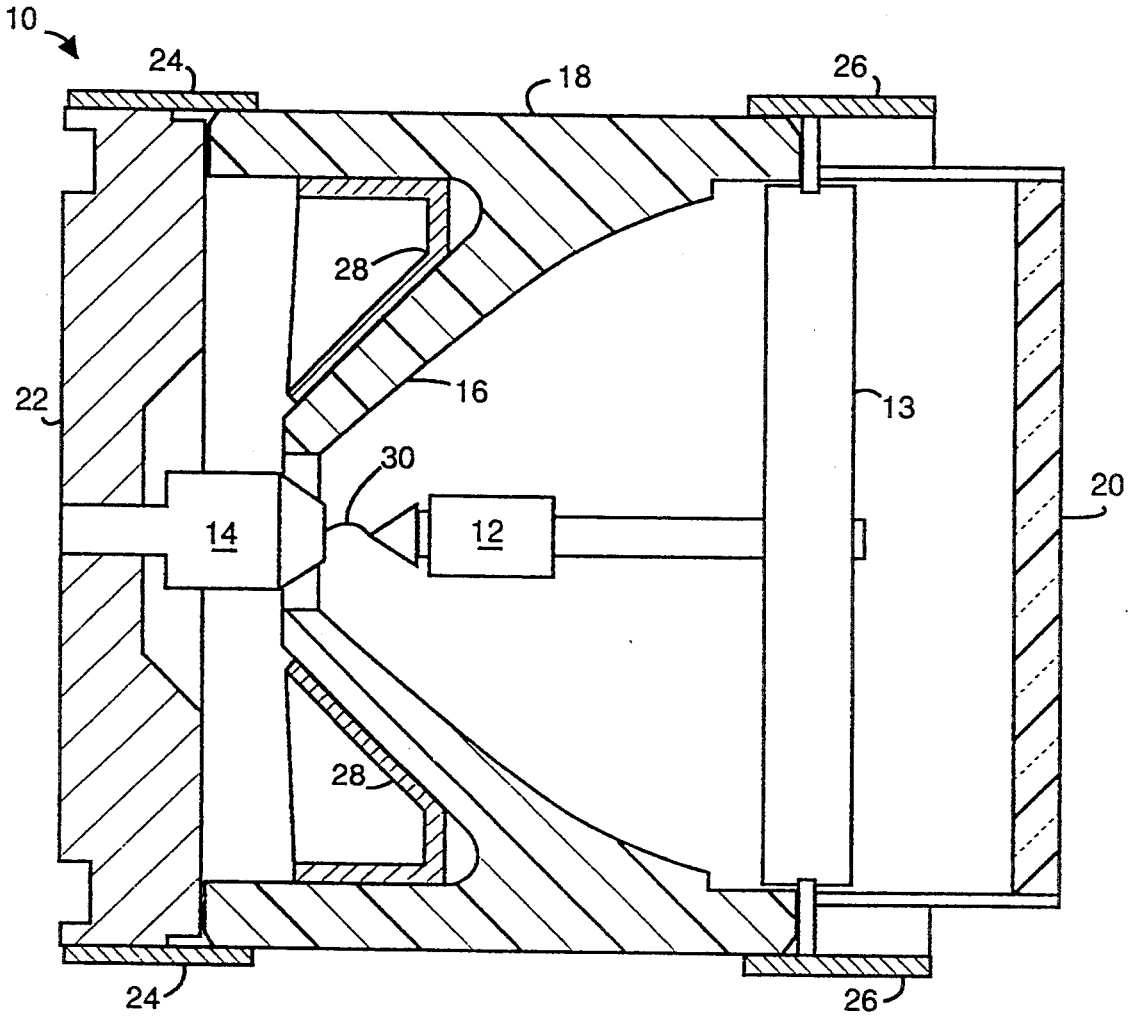
Fig. 1 (prior art)
FIG. 1 is a cross-sectional view of a prior art, cylindrically-shaped, high-intensity short arc lamp.
Figure 2:
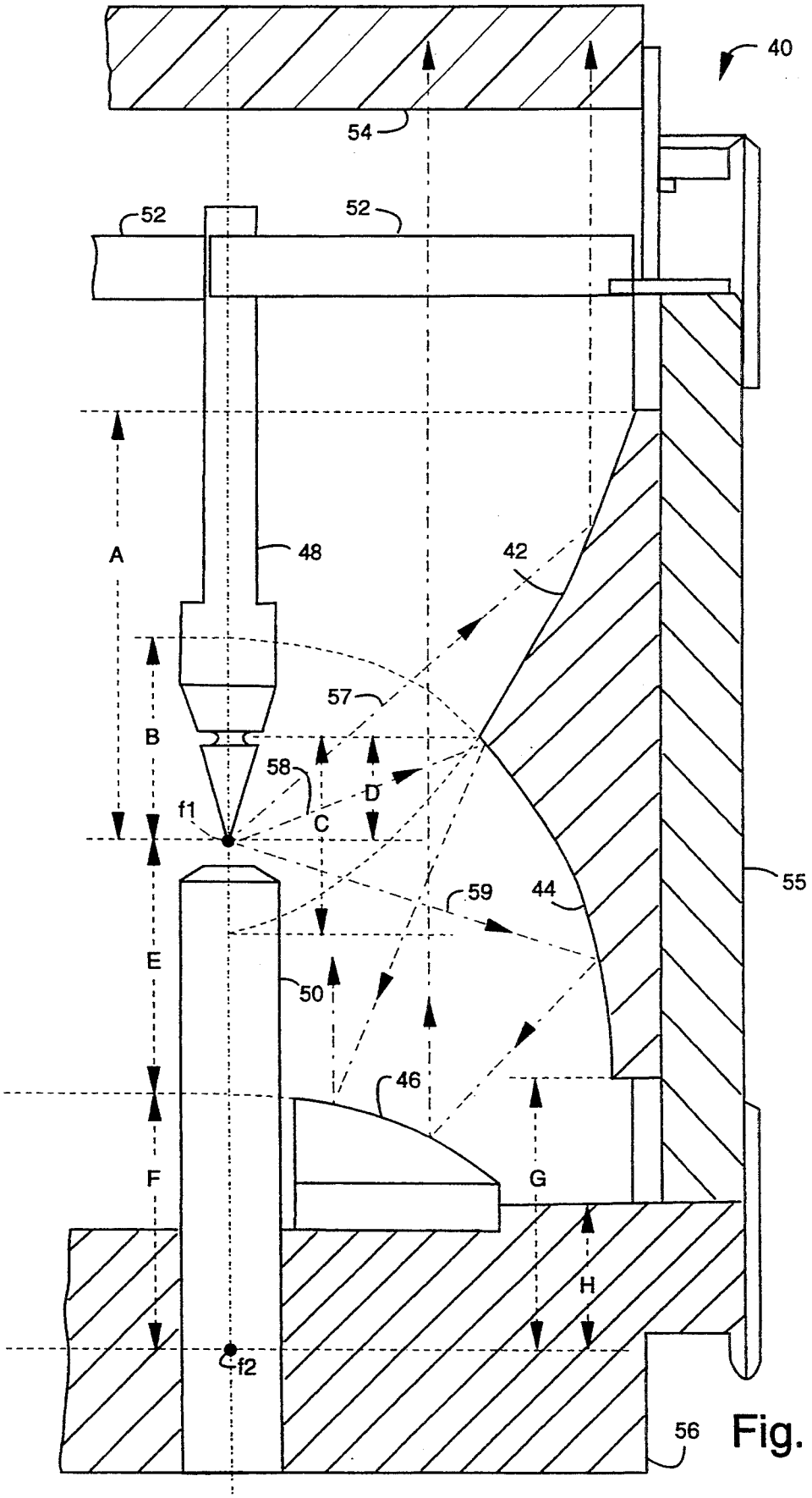
FIG. 2 is a partial cross-sectional view of a first arc lamp embodiment of the present invention.

FIG. 2 illustrates an arc lamp embodiment of the present invention, referred to herein by the general reference numeral 40. The lamp 40 is cylindrical in shape and comprises an upper parabolic reflector 42, an intermediate elliptical reflector 44, a lower parabolic reflector 46, a cathode 48, an anode 50, a set of cathode supports 52, a sapphire lens or window 54, a main body 55 and a base 56. When a proper power supply potential is placed between cathode 48 and anode 50, an electrical arc will form that intensely radiates light from a focal point "f1" Point f1 is a focal point for both parabolic reflector 42 and elliptical reflector 44. Light from point f1 will be reflected by reflector 44 to a second focal point "f2". Point f2 is a focal point for both elliptical reflector 44 and parabolic reflector 46. Focal points f1 and f2 are collinear with a central axis of lamp 40. Such light reflected by reflector 44 will be intercepted by reflector 46 before reaching f2 and will be reflected by reflector 46 in rays that are essentially parallel to the axis of f1 and f2 and that exits through window 54. Rays of light that reach reflector 42 directly from point f1 will be reflected in rays that also are essentially parallel to the axis of f1 and f2 and that exit through window 54.

The triplet combination of reflectors 42, 44 and 46 provide for a "flat-top" beam that reduces in intensity to 50% of its maximum in a five degree total beam angle. A conventional parabola based lamp will only diminish in intensity to 17% of its maximum in a similar five degree angle.

A set of three sample rays 57–59 are illustrated in FIG. 2 to help explain the operation of lamp 40. Ray 57 leaves the area of f1 and is reflected out window 54 parallel to the axis of f1 and f2 by reflector 42. Ray 58 leaves the area of f1 at a lower angle than ray 57 and is reflected directly toward f2 by reflector 44. Ray 58 however encounters reflector 46 and is reflected out window 54 parallel to the axis of f1 and f2. Ray 59 leaves the area of f1 at a lower angle than ray 58 and is also reflected directly toward f2 by reflector 44. Ray 59 also encounters reflector 46 and is reflected out window 54 parallel to the axis of f1 and f2. An arc that produces light in the area of f1 bridges between cathode 48 and anode 50 in a line segment. In the prior art, this line segment of source light was responsible for a divergence of light of individual ray paths. For example, in the prior art, reflector 42 would extend down to anode 50 and catch rays 58 and 59. The close proximity of reflector 42 to the line segment of source light produced rays exiting window 54 that had divergences that approached 14.5°. In lamp 40, the longer paths taken by ray 58 and 59 to reflector 44 reduce such divergence angles to about 2.5° .

Table I summarizes the dimensions (in inches) that are expected to produce improved beam shapes for an implementation of lamp 40. Reflectors 42 and 44 intersect at a radius of 0.5985 inches. Main body 55 is approximately 2.180 inches in diameter and has a longitudinal length of 2.220 inches.

TABLE I

| Dimension | Value (inches) |
|---|---|
| A | 1.020 |
| B | 0.510 |
| C | 0.4478 |
| D | 0.2479 |
| E | 0.600 |
| F | 0.535 |
| G | 0.575 |
| H | 0.275 |

The concave parabolic surface of reflector 42 generally conforms to $y^2=0.8$ X, where "Y" is a distance along the axis of projection and "X"0 is a distance perpendicular from the axis of projection. The concave elliptical surface of reflector 44 generally conforms to $$\frac{X^2}{(1.077)^2}+\frac{Y^2}{(0.9153)^2}=1.$$

The convex parabolic surface of reflector 46 generally conforms to $Y^2=2.140$

X.

Figure 3:
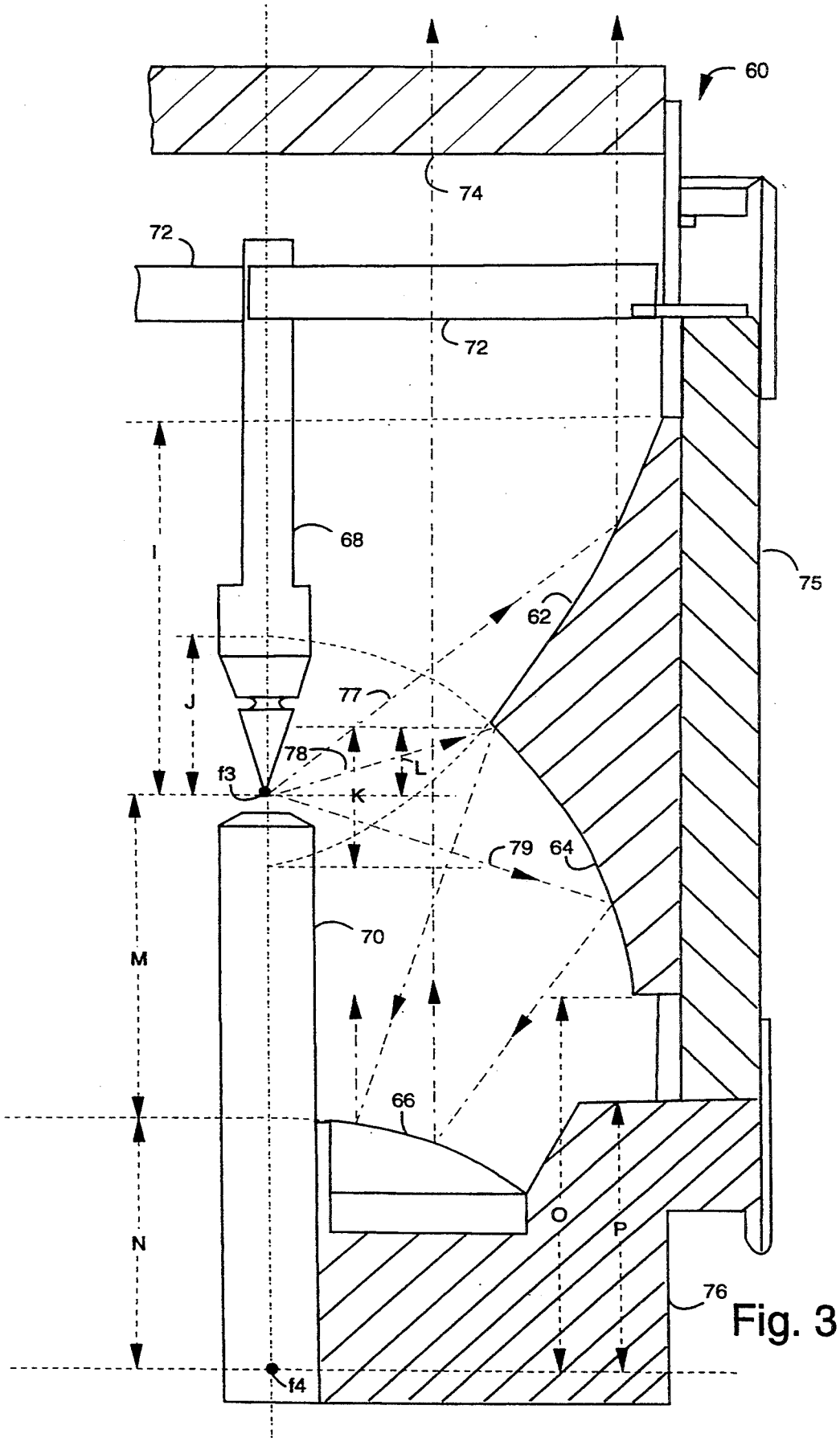
FIG. 3 is a partial cross-sectional view of a second arc lamp embodiment of the present invention.

FIG. 3 illustrates another arc lamp embodiment of the present invention, referred to herein by the general reference numeral 60. The lamp 60 is also cylindrical in shape and comprises an upper parabolic reflector 62, an intermediate elliptical reflector 64, a lower parabolic reflector 66, a cathode 68, an anode 70, a set of cathode supports 72, a glass lens or sapphire window 74, a main body 75 and a base 76. When a proper power supply potential is placed between cathode 68 and anode 70, an electrical arc will form that intensely radiates light from a focal point "f3". Point f3 is a focal point for both parabolic reflector 62 and elliptical reflector 64. Light from point f3 will be reflected by reflector 64 to a second focal point "f4". Point f4 is a focal point for both elliptical reflector 64 and parabolic reflector 66. Focal points f3 and f4 are collinear with a central axis of lamp 60. Such light reflected by reflector 64 will be intercepted by reflector 66 before reaching f4 and will be reflected by reflector 66 in rays that are essentially parallel to the axis of f3 and f4 and that exits through window 74. Rays of light that reach reflector 62 directly from point f3 will be reflected in rays that also are essentially parallel to the axis of f3 and f4 and that exit through window 74.

The triplet combination of reflectors 62, 64 and 66 provide for a "flat-top" beam that reduces in intensity to 70% of its maximum in a five degree total beam angle. A conventional parabola based lamp will only diminish in intensity to 17% of its maximum in a similar five degree angle.

A set of three sample rays 77–79 are also illustrated in FIG. 3 to help explain the operation of lamp 60. Ray 77 leaves the area of f3 and is reflected out window 74 parallel to the axis of f3 and f4 by reflector 62. Ray 78 leaves the area of f3 at a lower angle than ray 77 and is reflected directly toward f4 by reflector 64. Ray 78 however encounters reflector 66 and is reflected out window 74 parallel to the axis of f3 and f4. Ray 79 leaves the area of f3 at a lower angle than ray 78 and is also reflected directly toward f4 by reflector 64. Ray 79 also encounters reflector 66 and is reflected out window 74 parallel to the axis of f3 and f4. An arc that produces light in the area of f3 bridges between cathode 68 and anode 70 in a line segment. In the prior art, this line segment of source light was responsible for a divergence of light of individual ray paths. For example, in the prior art, reflector 62 would extend down to anode 70 and catch rays 78 and 79. The close proximity of reflector 62 to the line segment of source light produced rays exiting window 74 that had divergences that approached 14.5°. In lamp 60, the longer paths taken by rays 78 and 79 to reflector 64 reduce such divergence angles to about 2.5°.

Table II summarizes the dimensions (in inches) that are expected to produce improved beam shapes for an implementation of lamp 60. Reflectors 62 and 64 intersect at a radius of 0.563 inches. Main body 75 comprises ceramic and is approximately 2.180 inches in diameter and has a longitudinal length of 2.220 inches.

TABLE II

| Dimension | Value (inches) |
|---|---|
| I | 1.020 |
| J | 0.440 |
| K | 0.3963 |
| L | 0.1963 |
| M | 0.900 |
| N | 0.680 |
| O | 1.037 |
| P | 0.737 |

The concave parabolic surface of reflector 62 generally conforms to $Y^2=0.8$ X, where "Y" is a distance along the axis of projection and "X" is a distance perpendicular from the axis of projection. The concave elliptical surface of reflector 64 generally conforms to $$\frac{X^2}{(1.230)^2}+\frac{Y^2}{(0.9427)^2}=1.$$

The convex parabolic surface of reflector 66 generally conforms to $Y^2=2.720\ X$.

Figure 4:
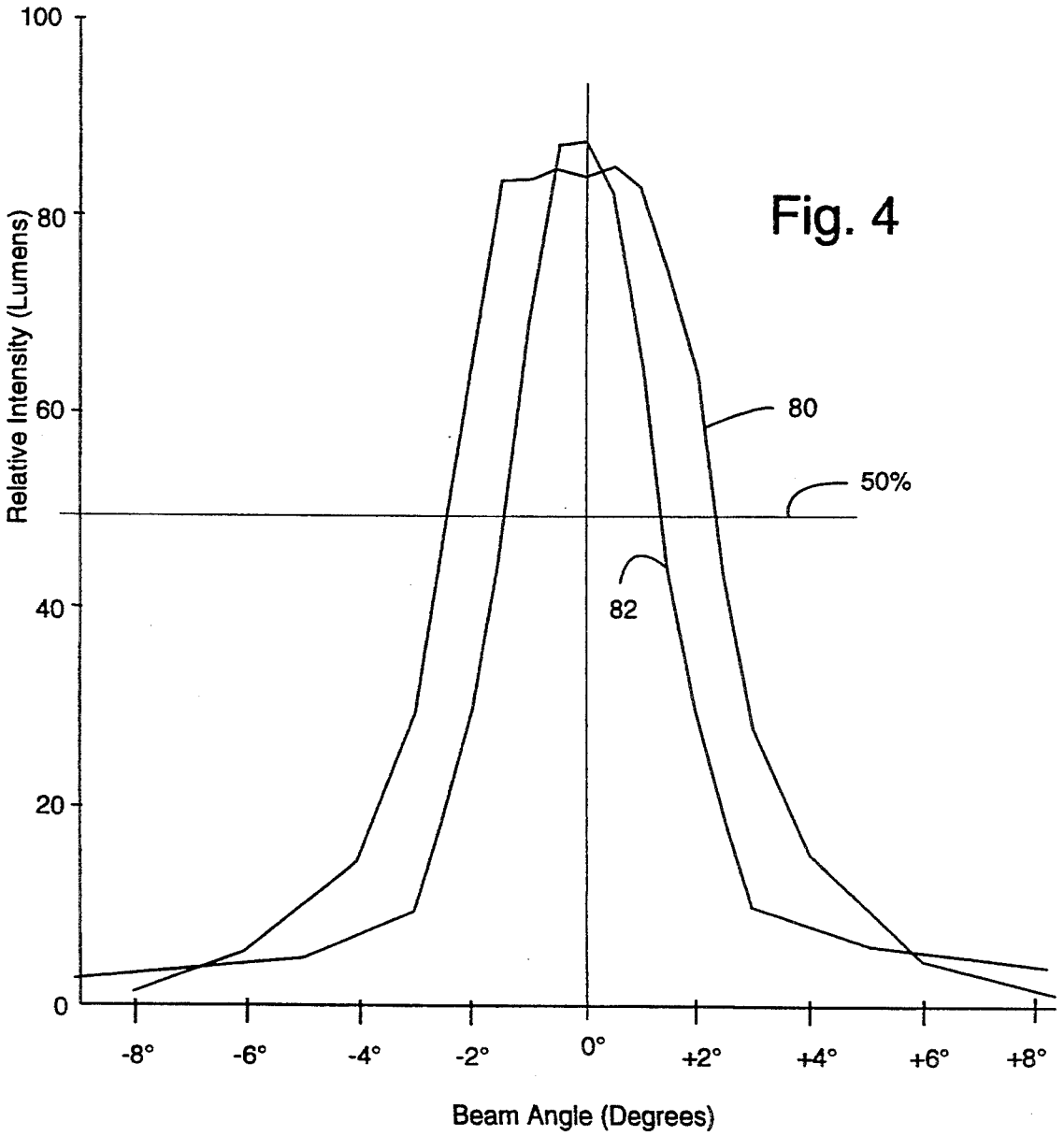
FIG. 4 is a graph comparing the light output of lamps such as those of FIGS. 2 and 3 with one similar to the lamp of FIG. 1.

FIG. 4 shows the results of a comparative test between a conventional arc lamp and one of the present invention, such as lamp 40 or 60. The three reflector, triplet configuration of the present invention produced an output represented by a curve 80. A standard parabolic type prior art arc lamp produced the light output represented by a curve 82. Curve 80 has a wider, flatter top than does curve 82 centered around a zero degree beam angle.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A lamp (40) for uni-axial projection of a beam of light in a forward direction along an axis of the lamp, comprising:

a source of light (48, 50) positioned along said axis of the lamp a first annular reflector (42) with a concave parabolic surface with a focus projecting in said forward direction and proximate to the source of light and positioned to reflect a light (57) from the source of light along said axis of said lamp in said forward direction from a position entirely in said forward direction from said source of light;

a second annular reflector (44) with a concave elliptical surface with a focus projecting opposite to said forward direction and proximate to the source of light and positioned to reflect a light (59) from the source of light from a position adjacent to the first annular reflector (42) on aside opposite to said forward direction; and a third annular reflector (46) with a convex parabolic surface with a focus projecting opposite to said forward direction and proximate to the source of light and positioned to receive said light (59) reflected from the second annular reflector (44) in the direction opposite to said forward direction along said axis of the lamp from a position adjacent to the second annular reflector (44) on a side opposite to said forward direction.

2. The lamp of claim 1, wherein:

the source of light comprises an arc lamp with an anode (50) and a cathode (48) longitudinally positioned along and concentric with said axis of the lamp (40).

3. The lamp of claim 1, wherein:

said concave parabolic surface generally conforms to $Y^2=0.8\ X$, where "Y" is a distance along said axis of the lamp (40) and "X" is a distance perpendicular from said axis of the lamp (40).

4. The lamp of claim 1, wherein:

said concave elliptical surface generally conforms to $$\frac{X^2}{(1.077)^2}+\frac{Y^2}{(0.9153)^2}=1,$$

where "Y" is a distance along said axis of the lamp (40) and "X" is a distance perpendicular from said axis of the lamp (40).

5. The lamp of claim 1, wherein:

said convex parabolic surface generally conforms to $Y^2=2.140\ X$, where "Y" is a distance along said axis of the lamp (40) and "X" is a distance perpendicular from said axis of the lamp (40).

6. The lamp of claim 1, wherein:

said concave elliptical surface generally conforms to $$\frac{X^2}{(1.230)^2}+\frac{Y^2}{(0.9427)^2}=1,$$

where "Y" is a distance along said axis of the lamp (40) and "X" is a distance perpendicular from said axis of the lamp (40).

7. The lamp of claim 1, wherein:

said convex parabolic surface generally conforms to $Y^2=2.720\ X$, where "Y" is a distance along said axis of the lamp (40) and "X" is a distance perpendicular from said axis of the lamp (40).

8. An arc lamp (40) for projecting light in a narrow beam in a single forward direction along an axis of projection, comprising:

arc discharge means (48, 50) for producing a high intensity source of light at a point "A" along said axis of projection;

an annular concave parabolic reflector (42) that is concentric with said axis of projection and has a focal point coincident with point "A" for reflecting light in rays parallel to said axis of projection in said single direction and positioned entirely in said forward direction from said point "A";

an annular concave elliptical reflector (44) that is concentric with said axis of projection and that has a first focal point coincident with point "A" and a second focal point coincident with a point "B" which is collinear with point "A" along said axis of projection, said concave elliptical reflector positioned adjacent the annular concave parabolic reflector on a side opposite to said forward direction; and an annular convex parabolic reflector (46) that is concentric with said axis of projection and has a focal point coincident with point "B" for reflecting light in rays parallel to an axis of projection in a single direction that have been reflected from the concave elliptical reflector and positioned entirely opposite said forward direction from said point "A".

9. The lamp of claim 8, wherein:

the arc discharge means (48, 50) comprises an arc lamp with an anode (50) and a cathode (48) longitudinally positioned along said axis of projection.

10. The lamp of claim 8, wherein:

said concave parabolic reflector (42) generally conforms to $Y^2=0.8\ X$, where "Y" is a distance along said axis of projection and "X" is a distance perpendicular from said axis of projection.

11. The lamp of claim 8, wherein:

said concave elliptical reflector (44) generally conforms to $$\frac{X^2}{(1.077)^2} + \frac{Y^2}{(0.9153)^2} = 1,$$

where "Y" is a distance along said axis of projection and "X" is a distance perpendicular from said axis of projection.

12. The lamp of claim 8, wherein:

said convex parabolic reflector (46) generally conforms to $Y^2 2.140\ X$, where "Y" is a distance along said axis of projection and "X" is a distance perpendicular from said axis of projection.

13. The lamp of claim 10, wherein:

said concave elliptical reflector (44) generally conforms to $$\frac{X^2}{(1.230)^2} + \frac{Y^2}{(0.9427)^2} = 1,$$

where "Y" is a distance along said axis of projection and "X" is a distance perpendicular from said axis of projection.

14. The lamp of claim 13, wherein:

said convex parabolic reflector (46) generally conforms to $Y^2 2.720\ X$, where "Y" is a distance along said axis of projection and "X" is a distance perpendicular from said axis of projection.

* * * * *